United States Patent [19]

Kam et al.

[11] 4,428,636

[45] Jan. 31, 1984

[54] MULTI-CONTACT CONNECTORS FOR CLOSELY SPACED CONDUCTORS

[75] Inventors: Lit-Yam Kam, Camp Hill; Billy E. Olsson, New Cumberland, both of Pa.

[73] Assignee: AMP Incorporated, Harrisburg, Pa.

[21] Appl. No.: 318,534

[22] Filed: Nov. 5, 1981

[51] Int. Cl.[3] ..... H01R 13/39

[52] U.S. Cl. ..... 339/97 P

[58] Field of Search ..... 339/17 LC, 97 R, 97 P, 339/99 R, 217 S

[56] References Cited

U.S. PATENT DOCUMENTS

| | | | |
|---|---|---|---|
| 2,344,766 | 3/1944 | Deakin | 339/99 R |
| 2,923,911 | 2/1960 | Demurjian | 339/217 S |
| 2,953,765 | 9/1960 | Treasley | 339/217 S |
| 3,007,132 | 10/1961 | Anderson | 339/217 S |
| 3,835,445 | 9/1974 | Hardesty | 339/99 R |
| 3,860,318 | 1/1975 | Reavis, Jr. et al. | 339/99 R |
| 4,002,392 | 1/1977 | Hardesty | 339/99 R |
| 4,176,895 | 12/1979 | Aldridge | 339/17 CF |
| 4,188,085 | 2/1980 | Aldridge et al. | 339/176 MP |
| 4,231,628 | 11/1980 | Hughes et al. | 339/171 C |

*Primary Examiner*—Joseph H. McGlynn

*Attorney, Agent, or Firm*—F. W. Raring

[57] ABSTRACT

Preloaded electrical connector receptacle has contact receiving cavities extending into one of its sidewalls. A recess extends from each cavity to the mating face and an opening is provided in the hood which communicates with the recesses. Flat stamped terminals are partially inserted into the cavities and have insulation piercing tangs which engage conductors inserted into a conductor receiving opening that extends inwardly from the rearward face of the housing. The terminals are connected to the conductors by fully inserting the terminals into their cavities. The terminals have cantilever spring arms extending through the recesses and into the openings in the hood. The ends of the arms engage terminals in a complementary plug when the plug is coupled to the receptacle.

5 Claims, 8 Drawing Figures

MULTI-CONTACT CONNECTORS FOR CLOSELY SPACED CONDUCTORS

This invention relates to preloaded electrical connector receptacles and connector plugs of the type having flat stamped terminals on closely spaced centers.

U.S. Pat. No. 4,022,392 discloses a connector plug comprising an insulating housing having terminal receiving recess extending into one of its sidewalls and having cable receiving recesses extending into its rearward face. The cable receiving recess intersects the inner ends of the terminal receiving cavities or recesses and flat stamped terminals are partially inserted into the cavities. The terminals have insulation piercing tangs on their ends so that when the cable is inserted into the cable receiving recess and the terminals are fully inserted into their cavities, the tangs will penetrate the cable and establish electrical contact with the cable conductors. The portions of the flat terminals which are adjacent to the housing sidewall are contacted when the plug is mated with a connector receptacle. The plug shown in U.S. Pat. No. 4,002,392 is adapted to be used with a receptacle of a type commonly referred to as a jack and shown, for example, in U.S. Pat. No. 4,292,736.

It would be desirable to adapt the principles of the plug connector shown in U.S. Pat. No. 4,002,392 to use with multiconductor cables having a relatively large number of conductors therein and to provide a complementary connector receptacle for similar cables having large numbers of conductors. The receptacle shown in U.S. Pat. No. 4,292,736 cannot conveniently be installed on the end of a cable and is limited with respect to the number of contact terminals contained in the receptacle housing. The present invention is therefore directed to the achievement of a connector receptacle which can be installed on cables having a high number of conductors on closely spaced centers and which can be mated with a connector plug that can be installed on a cable end with equal facility. The invention is further directed to improved connectors for connecting cable conductors to circuit board conductors and connecting conductors on one circuit board to conductors on a second circuit board.

A preloaded multi-contact electrical connector receptacle in accordance with the invention comprises an insulating housing having a mating face, a rearward face, first and second oppositely directed sidewalls extending between the faces, and oppositely directed endwalls extending between the faces. A hood extends forwardly beyond, and surrounds, the mating face and has a free edge which is spaced from the mating face. A plurality of contact receiving cavities are provided in the housing in side-by-side relationship forming a row which extends between the housing endwalls. A receptacle terminal is disposed in each of the cavities. The hood is dimensioned to receive a connector plug having plug terminals therein which are mated with the receptacle terminals when the plug is inserted into the hood. The connector receptacle is particularly characterized in that the cavities extend inwardly from the first sidewall towards the second sidewall and are spaced from the mating face. A recess extends in the first sidewall from each cavity to the mating face and an opening is provided in the hood extending from the recess towards the free edge of the hood. Each of the receptacle terminals has a body portion which is contained in one of the cavities and a cantilever spring arm which extends through the associated recess and into the opening in the hood. Each cantilever spring arm has a free end which is spaced from the mating face of the receptacle connector and has a contact portion on the free end. When the complementary plug is inserted into the hood, the contact portions of the spring arms engage contact portions of the plug terminals which are adjacent to the surface of the plug which is opposed to the opening in the hood.

In accordance with further embodiments of the invention, the contact terminals are flat stamped members which can be placed on closely spaced centers and the spring arms of the receptacle terminals extend obliquely from the recesses adjacent to the mating face into the enclosure formed by the hood, the spring arms being flexed towards the hood upon movement of the plug connector into the enclosure.

In one embodiment of the invention, the terminals in the receptacle connector and the plug connector are partially inserted into their cavities and have insulation piercing tangs that engage cables inserted into cable receiving openings in the connector housings. The tangs establish contact with the cable conductors when the terminals are fully inserted. In other embodiments of the invention, the terminals have solder tabs which extend externally of the housings and are adapted to be soldered to conductors on circuit boards.

DRAWINGS DESCRIPTION

PREFERRED EMBODIMENT

Figure 2:
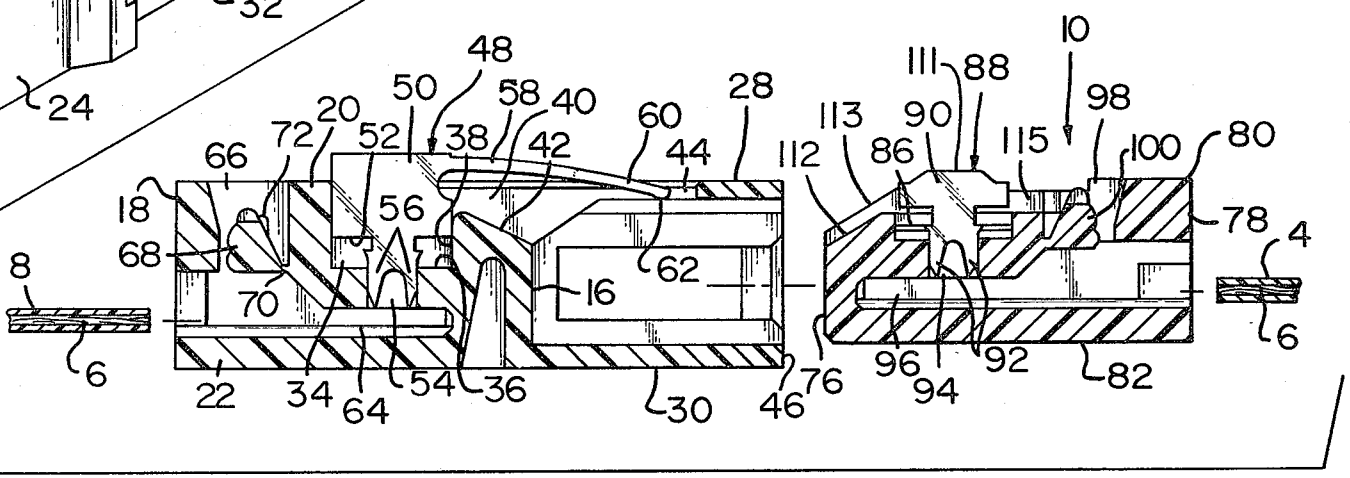
FIG. 2 is a view taken along the lines 2—2 of FIG. 1.
Figure 3:
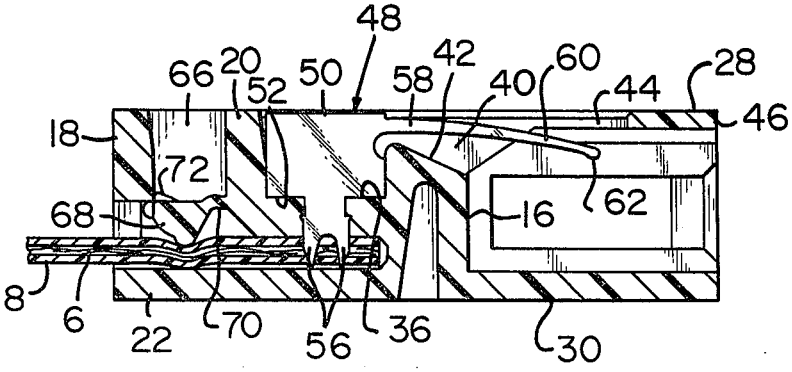
FIG. 3 is a sectional side view of the connector receptacle shown in FIG. 2, showing the positions of the parts after the connector has been installed on the end of a cable.
Figure 4:
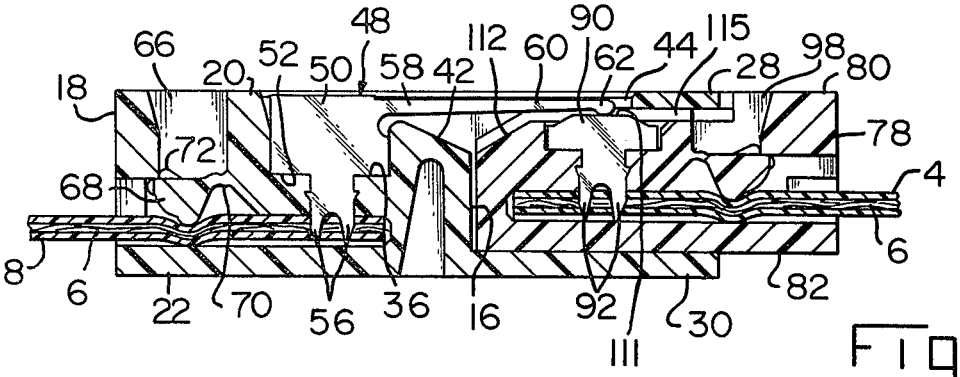
FIG. 4 is a sectional side view showing the receptacle connector and the plug connector installed on cables and coupled to each other.

The embodiment of the invention shown in FIGS. 1–4 serves to connect the side-by-side conductors 2 in a cable 4 to side-by-side conductors 6 in a cable 8. The connector assembly comprises a plug part 10 and a receptacle part 12 which are installed on the ends of the cables 4 and 8 respectively, and mated with each other as shown in FIG. 4.

The receptacle part 12 comprises a molded plastic housing 14 having a mating face 16, a rearward face 18, first and second sidewalls 20, 22 extending between the faces and first and second oppositely directed endwalls 24. The first sidewall 20 is the upper sidewall, as viewed in the drawing, and the second sidewall 22 is the lower sidewall. A hood 26 surrounds, and extends forwardly beyond, the mating face 16 and has a first or upper sidewall 28, a second or lower sidewall 30 and oppositely directed hood endwalls 32.

A plurality of contact receiving cavities 34 extend inwardly from the first sidewall 20 towards the second sidewall 22. Each cavity has an inner end 36 and a cavity extension 54 which extends from the inner end and communicates with a cable receiving opening 64 described below. Each cavity has a forward wall 38 which is adjacent to the mating face 16 and an associated recess 40 in the sidewall 20 of the housing. The recesses 40 extend to the mating face 16 and have downwardly inclined inner ends 42, for reasons which will be explained below. Narrow openings or slots 44 extend from the ends of the recesses 40 towards the free outer edge 46 of the hood.

A terminal 48 is partially inserted into each of the cavities 34, each terminal having a general rectangular body portion 50 from the lower edge 52 of which extend insulation piercing barbs 56. The barbs are disposed in the cavity extension of passageway 54 when the terminals are partially inserted, as shown in FIG. 2, and are moved into the opening 64 when the terminals are fully inserted. Retaining barbs 55 extend from the side edges of the insulation piercing barbs to retain the terminals in their fully inserted positions of FIG. 3.

A cantilever spring arm 58 extends from each terminal forwardly and has an outer or free end 60 which is formed and shaped as shown at 62 to provide a contact portion. The spring arms are in alignment with the recesses 40 and the openings 44.

Figure 1:
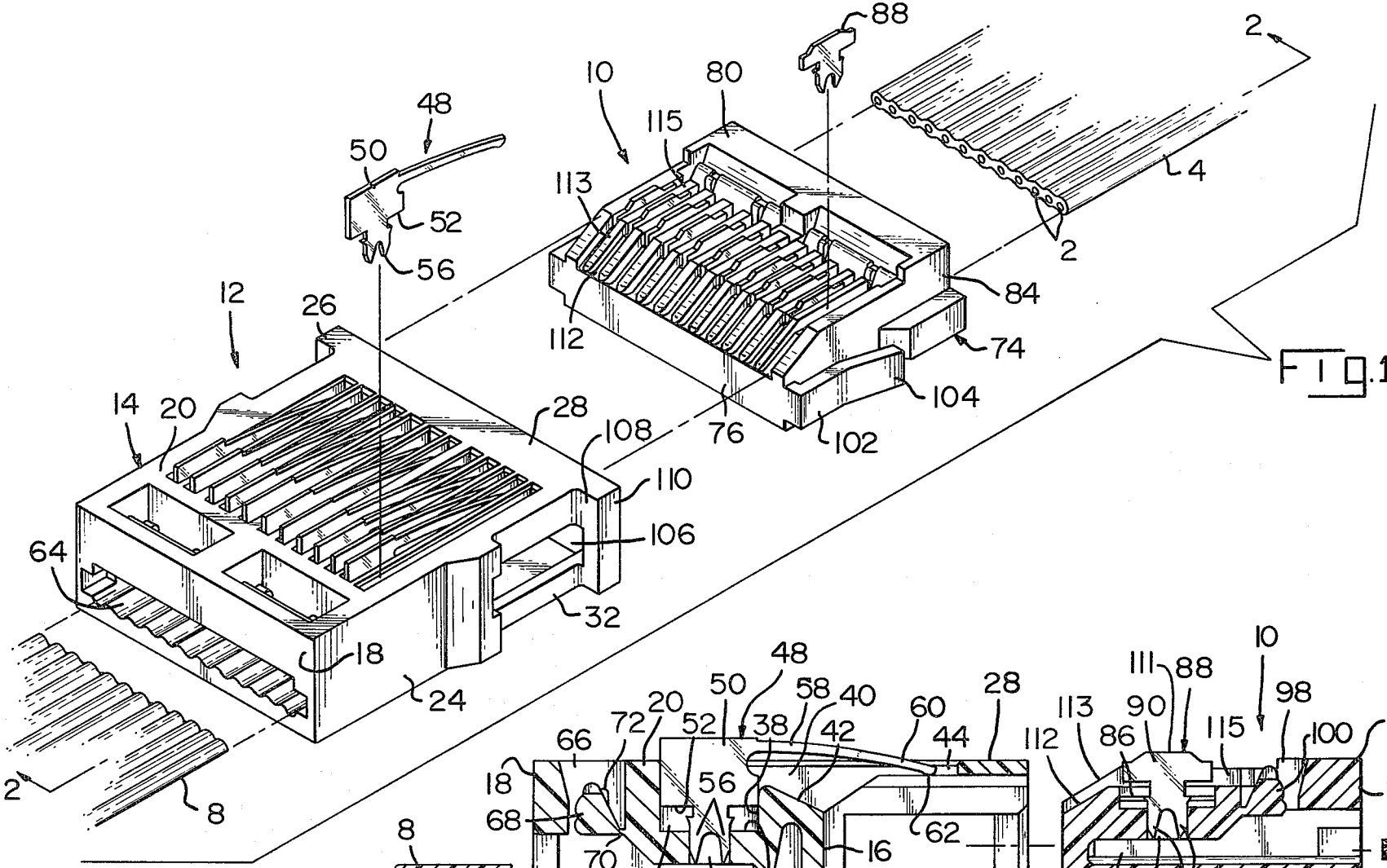
FIG. 1 is a perspective view of a plug connector and a receptacle connector in accordance with the invention in aligned relationship with each other, this view also showing cables in alignment with the connector housings and with terminals exploded from the connector housings.

The terminals 48 are preferably of the flat stamped or complanate type having all of their parts lying in the plane of the sheet metal from which they were produced. The terminals in the embodiment shown are quite thin, as are the cavities, and the connector is therefore adapted for cables on the conductors on closely spaced centers. Cavities and terminals are arranged in a row as shown in FIG. 1, which row is between the endwalls 24 of the housing and the hood 32.

A cable receiving opening 64 extends inwardly from the rearward face 18 of the housing and communicates with the cavity extensions 54 as shown in FIG. 2. When the terminals are to be connected to the conductors 6 in the cable 8, it is merely necessary to insert the cable into the opening 64 and thereafter move the terminals 48 downwardly to the positions shown in FIG. 3. The tangs 56 will be in alignment with the conductors 6 and will penetrate the cable and establish electrical contact with the conductors.

It is desirable to provide a strain relief for the cable in the form of cable clamping ears 68 disposed in wells 66 which are adjacent to the rearward face 18 of the housing. The ears 68 are connected to the body of the housing and a flexible hinge 70 and the ears are of generally triangular shape as shown and have locking projections 72 extending from one of the sides. The cable 8 is clamped by simply moving these ears from the position of FIG. 2 to the position of FIG. 3 in which the ears will bear against the cable and will be held against movement by the locking projections 72 that engage the left hand wall of the well 66. The housing is of suitable thermoplastic material that has properties such that the hinge 70 will flex and the locking ear 68 will be compressed during movement from the position of FIG. 2 to the position of FIG. 3.

The plug connector part 10 comprises a prismatic insulating housing 74 having a mating face 76, a rearward face 78, first and second sidewalls 80, 82 and oppositely directed endwalls 84. The contact receiving cavities 86 extend into the housing from the upper sidewall 80 and a terminal 88 is positioned in each of the cavities. The terminals are similar to those shown in U.S. Pat. No. 4,002,392 and have body portions 90 from which insulation piercing tangs 92 extend. The tangs are received in passageways 94 that extend from the cavities to a cable receiving opening 96 that extends inwardly from the rearward face 78. Wells 98 are provided between the cavities and the rearward face 78 and a locking ear 100, as previously described, is positioned in each well.

The connector plug is installed on the end of the cable 4 by inserting the cable into the cable receiving opening 96 and thereafter moving the terminals 88 to their fully inserted positions so that the tangs 92 penetrate the cable and establish contact with the cable conductors 2. The strain relief locking ear 100 is moved into the cable receiving opening, as was previously described.

The plug part 10 can be latched to the receptacle part 12 by means of latch arms 102 which extend from the endwalls 84 of the plug part and which have divergent ends 104. The endwalls 32 of the hood 26 of the receptacle part have openings 106 therein and the hood has laterally extending flanges 110 that provide stop surfaces 108 for the ends 104 of the latch arms. When the plug part is moved into the hood, the latch arms are flexible inwardly and the ends 104 move past the surfaces 108 at which time the ends of the latch arms return to their normal positions and retain the parts in coupled relationship. De-coupling can be achieved by flexing the latch arms inwardly and pulling the plug from the receptacle.

The plug part 10 has an inclined surface 112 extending from a location adjacent to the cavities to a mating face 76. As shown in FIG. 3, the cantilever spring arms 58 extend obliquely in the recesses 40 and openings 44 into the enclosure formed by the hood 26 of the receptacle part. The inclined surfaces 42 of the recesses provide clearance for the obliquely extending spring arms. When the parts are mated, the inclined leading surface 112 of the plug part 10 engages the contact portions 62 of the spring arms and deflects the arms upwardly so that the contact portions engage the upper edges 111 of the plug terminals 88 as shown in FIG. 4. Spaced-apart barriers 113 are provided on the inclined surface 112 and merge with similar barriers 115 which are between the cavities 86. The barriers guide the ends 60 of the cantilever spring arms 58 to the terminals 88 in the plug and ensure that an individual spring arm does not engage a terminal 88 other than the one with which it is intended to be mated.

A connector in accordance with FIGS. 1–4 can be produced in an extremely small size capable of being installed on a cable having its conductors 2 or 6 spaced apart by only 1.27 mm. The overall length between the end of the hood and the rearward face of a receptacle connector for a cable having 1.27 mm conductor spacing can be 20.83 mm and the height of the housing 7.6 mm. The overall length of the corresponding plug is 15.2 mm. This compact arrangement can be achieved by the use of the flat stamped terminals in the receptacle and in the plug connectors.

Figure 5:
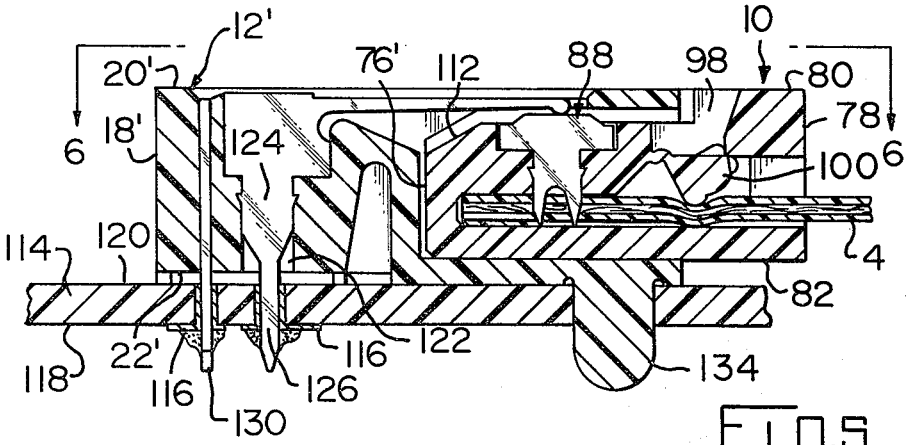
FIG. 5 is a view similar to FIG. 4 showing an alternative embodiment for connecting conductors in a cable to conductors on a circuit board.
Figure 6:
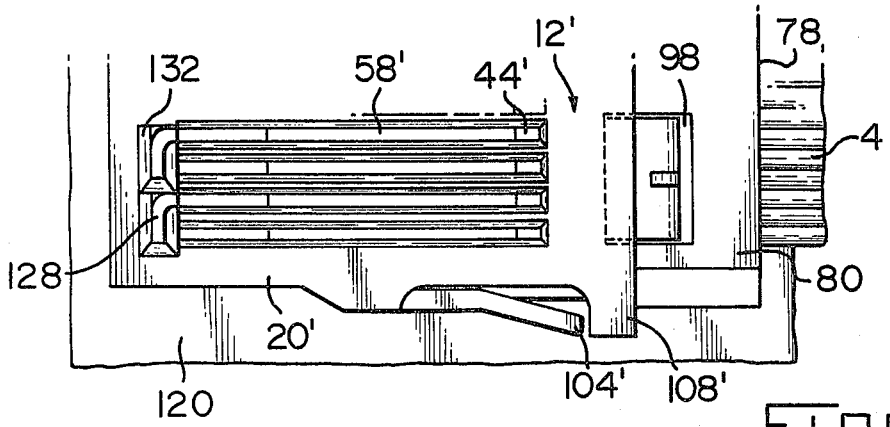
FIG. 6 is a view looking in the direction of the arrows 6—6 of FIG. 5.

FIGS. 5 and 6 show an embodiment of the invention for connecting the conductors in the cable 4 to conductors 116 on the lower surface 118 of a circuit board 114. A plug connector 10 as previously described, is used in this embodiment and is mated with a receptacle connector 12'. The connector 12' is similar in many respects to the connector 12 and the same reference numerals, where appropriate, are used and differentiated with prime marks.

The connector 12' differs from the connector 12 in that the cavity extension 122 extends from the terminal receiving cavity to the lower sidewall 22' and the terminals have reduced width sections 124 from which solder tabs 126 extend. The solder tabs are soldered to the conductors 116 as shown in FIG. 5. In the embodiment shown, alternate terminals have laterally extending extensions 128 which are received in cavity extensions 132. The solder tabs 130 of these alternate terminals are therefore in alignment with the solder tabs 126 of adjacent terminals. Advantageously, the hood of the receptacle 12' has an integral stabilizing boss 134 extending therefrom which is received in a hole in the circuit board. Several of these bosses may be provided as required, depending upon the width of the receptacle between its endwalls.

Figure 7:
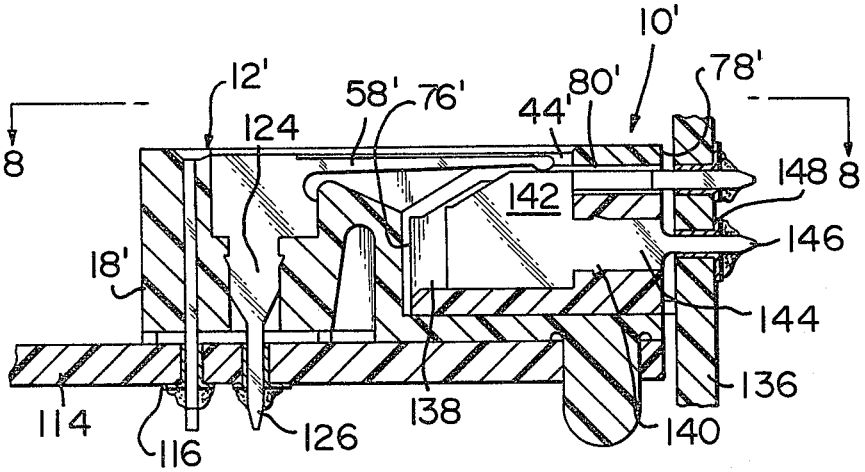
FIG. 7 is a side view of a further embodiment for connecting conductors on one circuit board to conductors on another circuit board.
Figure 8:
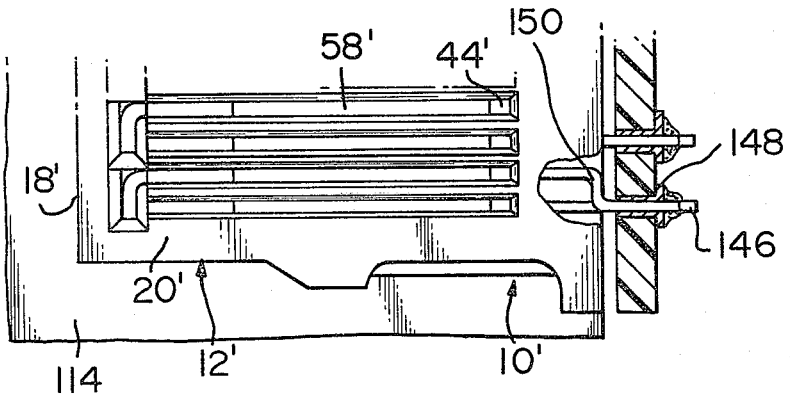
FIG. 8 is a view looking in the direction of the arrows 8—8 of FIG. 7.

FIGS. 7 and 8 show an embodiment for connecting the conductors 116 on the underside of the circuit board 114 to conductors 148 on a second circuit board 136 which extends normally of the circuit board 114. In this embodiment, a receptacle connector 12' as previously described, is used with a plug connector 10' having cavities 138 that extend inwardly from the mating face 76' and from the first sidewall 80'. The terminals 142 each has a body portion which is disposed in the cavity and a reduced width extension 144 which is received in a cavity extension 140 extending towards the rearward face 78' of the plug housing. Solder tabs 146 extend from the extensions 144 and are soldered to the conductors 148 on the circuit board 136. In this embodiment, alternate terminals in the plug 10' have offset solder tabs as shown at 150 in FIG. 8, so that the solder tabs of adjacent terminals in the plug 10' are in alignment with each other.

What is claimed is:

1. A multi-contact electrical connector receptacle of the type comprising a one piece insulating housing having a mating face, a rearward face, first and second oppositely directed sidewalls and oppositely directed endwalls extending between the faces, a hood extending forwardly beyond and surrounding, the mating face, the hood having a free edge which is spaced from the mating face, a plurality contact receiving cavities in the housing, the cavities being in side-by-side relationship in a row which extends between the housing endwalls, a receptacle terminal in each of the cavities, the hood being dimensioned to receive a connector plug having plug terminals therein which are mated with the receptacle terminals when the plug is inserted into the hood, the connector receptacle being characterized in that:

the receptacle terminals are flat stamped terminals having a thickness which is equal to the thickness of the stock metal from which the terminals were stamped, the cavities extend inwardly from the first sidewall towards the second sidewall, the cavities being spaced from the mating face and being spaced from the rearward face.

each of the cavities has an associated individual recess and an associated individual opening in the hood, the recesses extending in the one sidewall from their associated cavities to, and intersecting, the mating face, the openings extending from their associated recesses towards the free edge of the hood, each of the terminals has a body portion which is contained in one of the cavities and a cantilever spring arm which extends through the associated recess and into the associated opening, each cantilever spring arm having a free end which is spaced from the mating face and which is normally disposed within the hood whereby the free ends of the cantilever spring arms will engage, and establish electrical contact with, contact portions of plug terminals when a complementary plug connector is inserted into the hood.

2. A multi-contact electrical connector receptacle as set forth in claim 1 characterized in that at least one conductor receiving opening extends into the housing from the rearward face thereof and intersects at least one of the cavities, a conductor in the opening and the body portion of one of the terminals being electrically connected to the conductor.

3. A multi-contact electrical connector receptacle as set forth in claim 1 characterized in that a cable receiving opening extends into the housing from the rearward face and intersects the contact receiving cavities adjacent to the inner ends thereof, the receptacle terminals being partially inserted into the cavities and having insulation penetrating barbs thereon which penetrate the cable and establish electrical contact with the conductors of the cable when the receptacle terminals are moved to their fully inserted positions.

4. a multi-contact electrical connector receptacle as set forth in claim 1 characterized in that the contact terminals have solder tabs integral therewith, the solder tabs extending from the body portions of the terminals through the housing to the exterior of the housing, the connector being intended to be mounted on a circuit board, the solder tabs being intended for soldering to conductors on the circuit board.

5. A multi-contact electrical connector receptacle as set forth in claim 4 characterized in that the solder tabs extend from the second sidewall of the housing.

* * * * *